United States Patent [19]

Brissette

[11] Patent Number: 4,587,760

[45] Date of Patent: May 13, 1986

[54] CLOSURE PANEL HINGE ASSEMBLY

[75] Inventor: Lawrence P. Brissette, Utica, Mich.

[73] Assignee: General Motors Corporation, Detroit, Mich.

[21] Appl. No.: 754,155

[22] Filed: Jul. 12, 1985

[51] Int. Cl.[4] ..... E05D 15/30

[52] U.S. Cl. ..... 49/252; 49/386; 16/288; 16/289; 16/359

[58] Field of Search ..... 49/386, 350–352; 16/288, 289, 359, 360, 370, 302, 306

[56] References Cited

U.S. PATENT DOCUMENTS

| | | | |
|---|---|---|---|
| 2,639,462 | 5/1953 | Fish | 16/302 |
| 3,747,271 | 7/1973 | Adamski | 49/386 X |
| 3,978,549 | 9/1976 | Vitt | 16/370 X |
| 4,185,415 | 1/1980 | La Conte | 49/386 X |
| 4,206,944 | 6/1980 | Kumagai et al. | 296/76 |
| 4,223,483 | 9/1980 | Stafford | 49/386 |
| 4,402,111 | 9/1983 | Selby et al. | 16/308 |

*Primary Examiner*—Kenneth Downey
*Attorney, Agent, or Firm*—Patrick M. Griffin

[57] ABSTRACT

An improved closure panel hinge assembly is provided that gives an improved opening motion to a closure panel, such as a deck lid that has an edge disposed close to a vertical plane associated with the vehicle, such as the plane of a backlite. A pair of horizontal guide tracks and sliding pivots cooperate with an interconnected hinge strap, control link and follower link to shift the edge of the deck lid away from the back light as it is initially raised. Continued raising of the deck lid tilts it upwardly to an open position.

3 Claims, 5 Drawing Figures

CLOSURE PANEL HINGE ASSEMBLY

This invention relates to hinge assemblies in general and specifically to an improved closure panel hinge assembly for an automotive vehicle or the like.

BACKGROUND OF THE INVENTION

With decreasing vehicle sizes, it has become necessary to accommodate vehicle components in ever decreasing spaces. Traditionally, a closure panel such as a deck lid would be spaced from the vehicle rear window, generally known as a backlite, by a spacer panel. The spacer panel allowed the forward edge of the deck lid to shift forwardly of the vehicle, toward the backlite, without interference as the deck lid was raised to its open position. With a smaller vehicle, it may be desirable to eliminate the spacer panel, while interference between the deck lid edge and the backlite must still be prevented.

The U.S. Pat. No. 4,223,483 to Stafford, provides a closure hinge mechanism intended to deal with the problem described above. The hinge mechanism there disclosed includes a horizontal guide track 60 in which a roller on the end of a hinge arm 36 mounted to the deck lid 28 rides, giving a sliding pivot. A torsion bar 64 secured to deck lid 28 has its lower end pivoted to the vehicle compartment at 72, giving a fixed pivot. The patent specification recites that as lid 28 is raised, the dual simultaneous pivoting about the sliding and the fixed pivot will allow the edge of lid 28 to move upwardly and slightly rearwardly, that is, away from, the backlite 20. However, while the final position of the edge of lid 28 may in fact be spaced away from the backlite, it will initially move forwardly of the vehicle, toward the backlite, before moving away. While this may not present a problem with a sloped backlite, it may well represent a problem with a more vertically disposed backlite, or with a deck lid edge that rests closer to the backlite.

SUMMARY OF THE INVENTION

The invention provides a novel and improved closure panel hinge assembly that solves the problem outlined above.

The improved hinge assembly of the invention mounts a closure panel, a deck lid in the embodiment disclosed, to the body of an automotive vehicle. The deck lid moves between a generally horizontal closed position to a raised and tilted open position. In its closed position, the forwardmost edge of the deck lid rests close to the vehicle backlite, which may be disposed in a generally vertical plane, if desired. The hinge assembly of the invention allows the deck lid to be moved from its closed position toward its open position while shifting the edge of the deck lid away from the backlite to prevent interference therewith. Most broadly, the invention may be used to mount a closure panel having an edge to a vehicle or the like so as to allow it to be moved from a closed to an open position so as to prevent the closure panel edge from invading any generally vertical plane associated with the vehicle.

The hinge assembly includes a pair of generally horizontally extending guide tracks fixed to the vehicle body. A hinge strap is secured at its upper end to the deck lid. The lower end of the hinge strap is pivotally and slidably connected to the first guide track by a roller to provide a first sliding pivot.

A follower link has its upper end pivotally secured relative to the deck lid to provide a first movable pivot. The first movable pivot is conveniently provided by pivoting the upper end of follower link to the hinge strap, which is already secured to the deck lid. The lower end of the follower link is pivotally and slidably secured to the second guide track by a roller, providing a second slidable pivot.

A control link has one end pivotally secured to the forward end of the follower link, thus providing a second movable pivot. The other end of the control link is pivotally secured to the vehicle body to provide a fixed pivot. The position of the fixed pivot is such that when the control link is swung about the fixed pivot, its one end will move in an arcuate path. Over at least part of that arcuate path the control link one end will move upwardly and rearwardly of the vehicle body, that is, away relative to the vertical plane.

The above described structure cooperates to allow the deck lid to be moved from closed to open position without deck lid edge-vertical plane interference as follows. As the deck lid is initially raised from its closed position, the control link swings about its pivot and thereby moves the upper end of the follower link, and the first and second movable pivots, upwardly and away relative to the plane. During the initial raising of the lid, the follower link rotates relative to the deck lid about the first movable pivot and the control link rotates relative to the follower link about the second movable pivot. This initial movement of the control link and follower link serves to shift the edge of the deck lid upwardly and rearwardly of the vehicle body, away from the plane. This shifting is accommodated by the simultaneous sliding of the first and second sliding pivots, as the rollers roll horizontally along the first and second guide tracks respectively. Once the edge of the deck lid is so shifted away from the plane, continued raising of the deck lid causes it to continue to tilt upwardly as the follower link continues to rotate about the first movable pivot and the first and second slidable pivots slide farther along the first and second guide tracks. The deck lid edge stays clear of the plane during the upward tilting of the deck lid.

In addition, in the embodiment disclosed, the second sliding pivot does more than accommodate the initial shifting away of the edge of the deck lid. After the deck lid has tilted upwardly a certain amount to a partially open position, the one end of the control link will have moved through enough of its arcuate path that it will begin to move toward the plane, while still moving upwardly. This movement toward the plane tends to move the one end of the follower link upwardly and toward the plane as well. However, the second sliding pivot can now slide along the second guide track in the opposite direction, toward the plane, to accommodate the motion of the one end of the control link toward the plane. This allows the follower link to continue to rotate relative to the deck lid about the first movable pivot. The deck lid can thus tilt upwardly farther to the open position. The edge of the deck lid still does not move through the plane, despite the movement of the control link one end toward the plane. An improved opening motion is thus provided over two intervals of opening. In another embodiment of the invention, the guide tracks and links are assembled as a unit with a hinge box that can be attached in one step to the vehicle body, and a resilient means is included to aid in raising the deck lid and maintaining it in the open position.

It is, therefore, an object of the invention to provide an improved hinge assembly for mounting a closure panel to a vehicle body to move from a closed to an open position so that an edge of the closure panel does not invade a generally vertical plane associated with the vehicle body, including a hinge strap secured at one end to the closure panel and pivotally and slidably connected at the other end by a first slidable pivot to a first generally horizontal guide track, a follower link with one end secured at a first movable pivot relative to the closure panel and the other end pivotally and slidably connected by a second slidable pivot to a second generally horizontal guide track, and a control link with one end secured at a second movable pivot to the one end of the follower link and the other end secured at a fixed pivot to the vehicle body, so that, as the closure panel is initially raised, the control link will swing about the fixed pivot so as to move the one end of the follower link, and the first and second movable pivots, upwardly and away relative to the vertical plane as the control link rotates relative to the closure panel about the first movable pivot, thereby shifting the closure panel edge away from the plane in cooperation with the first and second guide tracks along which the first and second slidable pivots slide to accomodate the shifting, while continued raising of the lid allows the closure panel to tilt upwardly relative to the plane toward the open position as the follower link continues to rotate relative to the panel about the first movable pivot and the first and second sliding pivots continue to slide along the guide tracks.

It is another object of the invention to provide an improved hinge assembly of the type described in which the second slidable pivot, after the closure panel has been initially raised and tilted upwardly to a partially open position, slides in the opposite direction, toward the vertical plane, to accomodate movement of the one end of the control link and the second movable pivot toward the vertical plane, thereby allowing the closure panel to tilt upwardly farther to the open position as the follower link continues to rotate relative to the closure panel about the first movable pivot, while still preventing the closure panel edge from invading the vertical plane.

It is yet another object of the invention to provide an improved hinge assembly of the type described in which the structural elements are assembled together with a hinge box that may be joined to the vehicle body as a unit, including a resilient means to assist in raising the closure panel and maintaining it in open position.

DESCRIPTION OF THE PREEFERRED EMBODIMENT

These and other objects and features of the invention will appear from the following written description and drawings in which.

Figure 1:
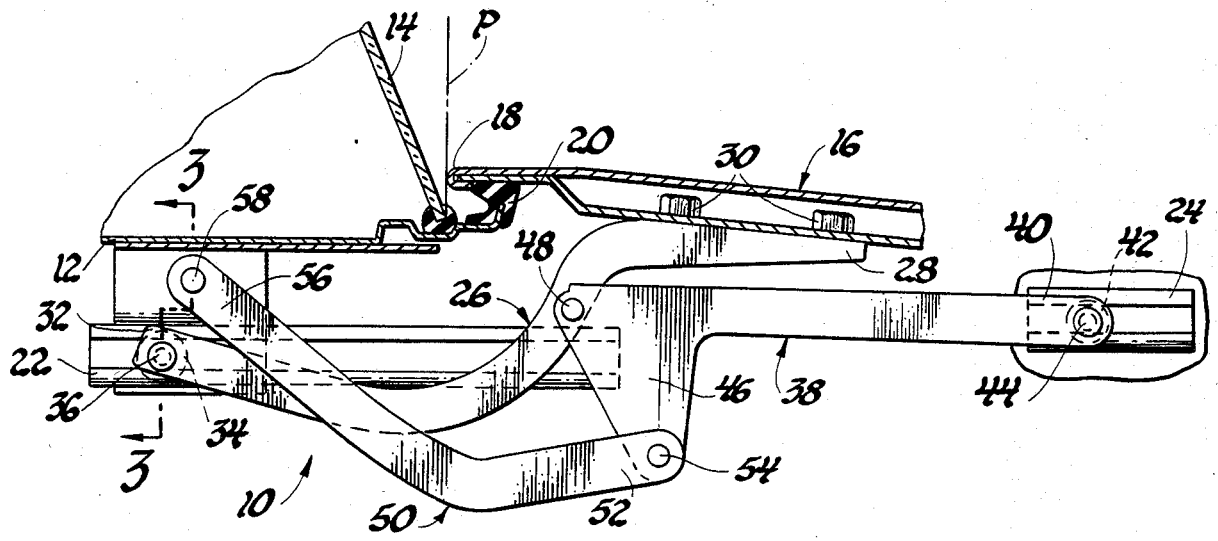
FIG. 1 is a view of a first embodiment of the invention with the closure panel in closed position.
Figure 2:
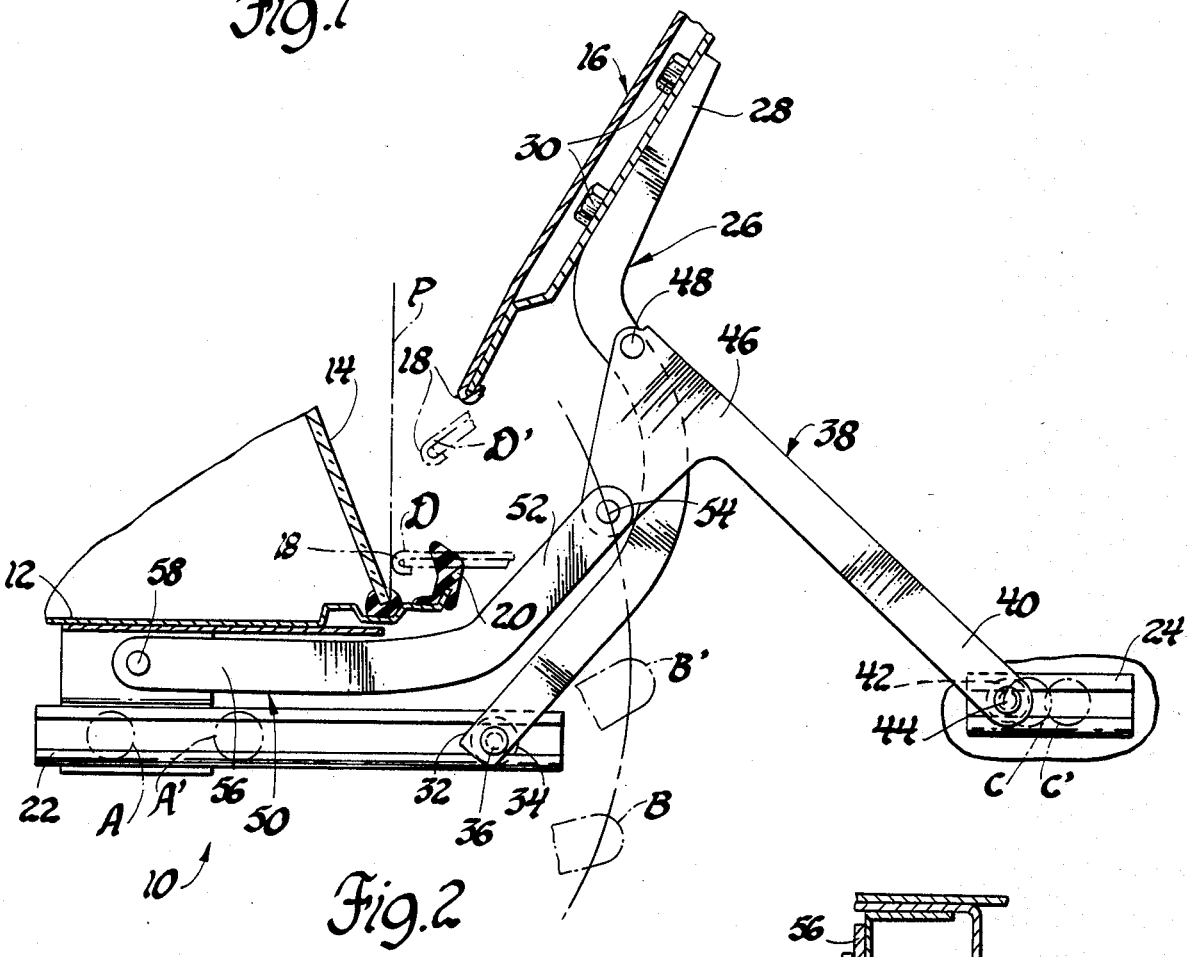
FIG. 2 is a view showing the FIG. 1 embodiment in open position in solid lines, with the locations of selected parts of the structure shown in dotted lines at the closed and at a partially open position of the closure panel.
Figure 3:
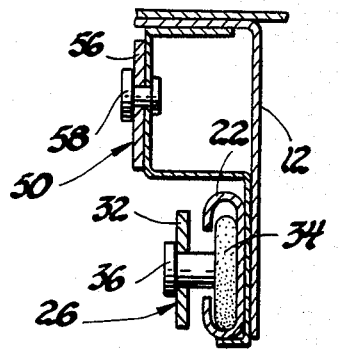
FIG. 3 is a sectional view taken along the line 3—3 of FIG. 1

Referring first to FIGS. 1–3, a first embodiment of the invention is designated generally at 10. An automotive vehicle includes body structure, a portion of which is designated at 12. Body structure 12 would generally form a compartment, such as a luggage compartment, along the front of which a backlite 14 would be mounted. Backlite 14 is shown with a slope, although it could be vertically disposed, as is the reference plane P shown in FIGS. 1 and 2. A closure panel, such as a deck lid indicated generally at 16, has a forwardmost edge 18 that extends generally parallel to backlite 14. Deck lid 16 is movable from the generally horizontal closed position of FIG. 1, to the open position of FIG. 2, which is raised and tilted upwardly relative to a vertically disposed reference plane P. In the closed position, edge 18 rests close to backlite 14, as is often the case in smaller vehicles, and compresses a sealing strip 20. The improved hinge assembly of the invention allows deck lid 16 to be raised such that edge 18 does not invade the plane P. Consequently, the edge 18 will not interfere with backlite 14, or with any other vehicle structure disposed on the plane P. It should be understood for purposes of the following description that the forward direction is to the left, and the rearward direction is to the right, although this would obviously be reversed if the hinge assembly were disclosed with an engine cover, rather than a deck lid.

Still referring to FIGS. 1–3, the hinge assembly 10 includes a first and second horizontally extending guide means provided by first and second guide tracks 22 and 24 respectively. Guide tracks 22 and 24 are identical in cross section which, as may be seen in FIG. 3, is essentially C-shaped. Guide tracks 22 and 24 are conveniently formed of stamped steel, and may be fixed to body structure 12 by welding, or any suitable means. First guide track 22 extends beneath backlite 14 and second guide track 24 is spaced rearwardly therefrom. Although guide tracks 22 and 24 need not be absolutely horizontal or absolutely straight, they should be generally horizontally extending, for reasons more fully discussed below.

A hinge strap 26 of a general S-shape has its upper end 28 secured to deck lid 16 near edge 18 by threaded fasteners 30. The lower end 32 of hinge strap 26 has a roller 34 of nylon or other suitable material pivoted thereto by headed pin 36. Roller 34 rides in first guide track 22 to thereby pivotally and slidably connect hinge strap lower end 32 to first guide track 22, and comprises a first sliding pivot. Other structures, such as a pin riding in a slot, could provide a sliding pivot, but roller 34 provides a convenient and low friction sliding pivot.

A follower link 38 of general L shape has its rearward end 40 similarly pivoted to a roller 42 by a headed pin 44. Roller 42 also rides in second guide track 24 to thereby pivotally and slidably connect end 40 to second guide track 24, and comprises a second sliding pivot. The forward end 46 of follower link 38 is pivotally secured by a headed pin 48 to hinge strap 26 near its upper end 28, providing a first movable pivot. Forward end 46 need not be pivoted directly to hinge strap 26, but could be pivoted instead to a separate bracket or some other structure that was in turn fixed to deck lid 16. The pivotal securement to hinge strap 26 provides a compact structure, however, which is important in the other embodiment discussed below.

A control link 50 has its rearward end 52 pivotally secured to the forward end 46 of follower link 38 by a headed pin 54, providing a second movable pivot spaced from the first movable pivot of pin 48. The forward end 56 of control link 50 is pivotally secured to body structure 12 above first guide track 22 and forward of backlite 14 by pin 58, providing a fixed pivot. The location of the fixed pivot of pin 58 assures that the rearward end 52 of control link 50 will move in an arc upwardly and initially away relative to the reference plane P as control link 50 swings about pin 58, shown in FIG. 2. Other locations of pin 58 could be used that would also cause the control link end 52 to swing in an arc that moved away from the reference plane P, but the location shown is practical and structurally compact. It should be understood that various ones of the connecting pins described above would be given the necessary length to assure that the structural elements that they connected would be horizontally spaced from one another sufficiently to rotate without rubbing. That is a practical consideration that does not concern the basic operation of the invention. Similarly, control link 50 has an offset shape to allow it to clear the bottom edge of backlite 14 in the open position of FIG. 2, but could otherwise be straight. The structural elements just described cooperate to give an improved motion of deck lid 16 between open and closed positions, as will be next described.

Referring again to FIG. 1, deck lid 16 is generally horizontal in its closed position, and edge 18 rests very close to backlite 14 and the plane P. The FIG. 1 closed positions of roller 34, first movable pivot 54, roller 42 and edge 18 are also shown in dotted lines at A through D respectively in FIG. 2. With a conventional hinge mechanism, the initial raising of deck lid 16 from the FIG. 1 closed position would cause edge 18 to move forwardly, through the reference plane P, as deck lid 16 tilted upwardly. With the hinge assembly 10 of the invention, the initial raising of deck lid 16 moves hinge strap 26 upwardly, in turn pulling follower link forward end 46 upwardly. Because follower link forward end 46 is pivotally secured to control link rearward end 52, control link 50 is caused to swing about the fixed pivot of pin 58. As control link rearward end 52 moves in the arc shown in FIG. 2, control link 50 rotates relative to follower link 38 about second movable pivot 54.

Still referring to FIG. 2, the arc that control link rearward end 52 follows moves initially upwardly and rearwardly, away from the plane P. In turn, follower link forward end 46 and the first and second movable pivots 48 and 54 initially move upwardly and rearwardly, away from reference plane P. As deck lid 16 is initially raised, it tilts upwardly as follower link 38 rotates relative to deck lid 16 about the first movable pivot 48. Concurrently, edge 18 shifts away from the plane P. The initial shifting of edge 18 is accommodated by the simultaneous sliding of the first and second slidable pivots provided by rollers 34 and 42. Rollers 34 and 42 roll rearwardly of the vehicle along the first and second guide tracks 22 and 24 respectively. Continued raising of deck lid 16 causes it to tilt upwardly farther as follower link 38 continues to rotate about first movable pivot 48. Concurrently, rollers 34 and 42 roll farther along first and second guide tracks 22 and 24 respectively. FIG. 2 shows a position to which each roller 34 and 42 moves during the continued raising of deck lid 16, from A and C to A′ and C′ respectively.

Still referring to FIG. 2, the upward and rearward movement of second movable pivot 54 that occurs as deck lid 16 is raised will continue until it reaches the point shown at B′. The corresponding position of edge 18 is shown at D′, at which point deck lid 16 may be defined as partially open. The corresponding positions of rollers 34 and 42 are the A′ and C′ positions noted above. Above the point B′, the arc followed by control link rearward end 52 will move the second movable pivot 54 farther upwardly, but now forwardly, toward reference plane P. Pivoting a control link at other positions on the body structure could, as was mentioned above, create an arc that would move away from the plane P over its entire path. However, the particular placement of control link 50 shown, and the resultant arc, gives an additional advantage beyond the initial shifting of edge 18 already described. The position C′ of roller 42 is the farthest rearward point that roller 42 reaches in second guide track 24. As deck lid 16 is raised farther from the partially open position, roller 42 then rolls from C′ in the opposite direction, to accomodate the movement of control link rearward end 52 and second movable pivot 54 toward the plane P. Roller 42 actually moves past the position it was in when deck lid 16 was closed, shown at C, to the solid line position. Roller 34, however, continues to roll in the same direction from its position A′ to the solid line position.

Still referring to FIG. 2, as rollers 34 and 42 are moving from the A′ and C′ positions respectively to the solid line positions, follower link 38 can simultaneously continue to rotate relative to deck lid 16 about first movable pivot 48. Deck lid 16 then tilts farther upwardly from the partially open position to the solid line open position. This further tilting moves deck lid 16 as a whole closer to the plane P, giving better access to any compartment that it might cover. However, edge 18 does not move so as to invade the plane P, and in fact moves relatively farther from plane P, from D′ to the solid line position. Therefore, an improved final opening motion, as well as an improved initial opening motion, is achieved. The opening motion described is reversed as deck lid 16 is lowered back to the FIG. 1 closed position.

Figure 4:
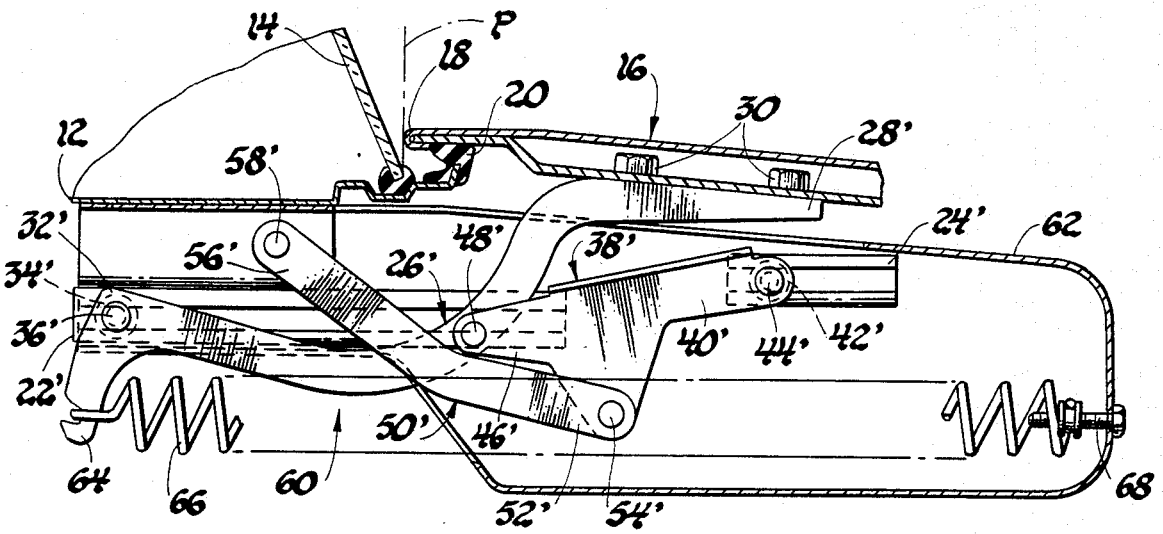
FIG. 4 is a view of a second embodiment of the invention with the closure panel in closed position.
Figure 5:
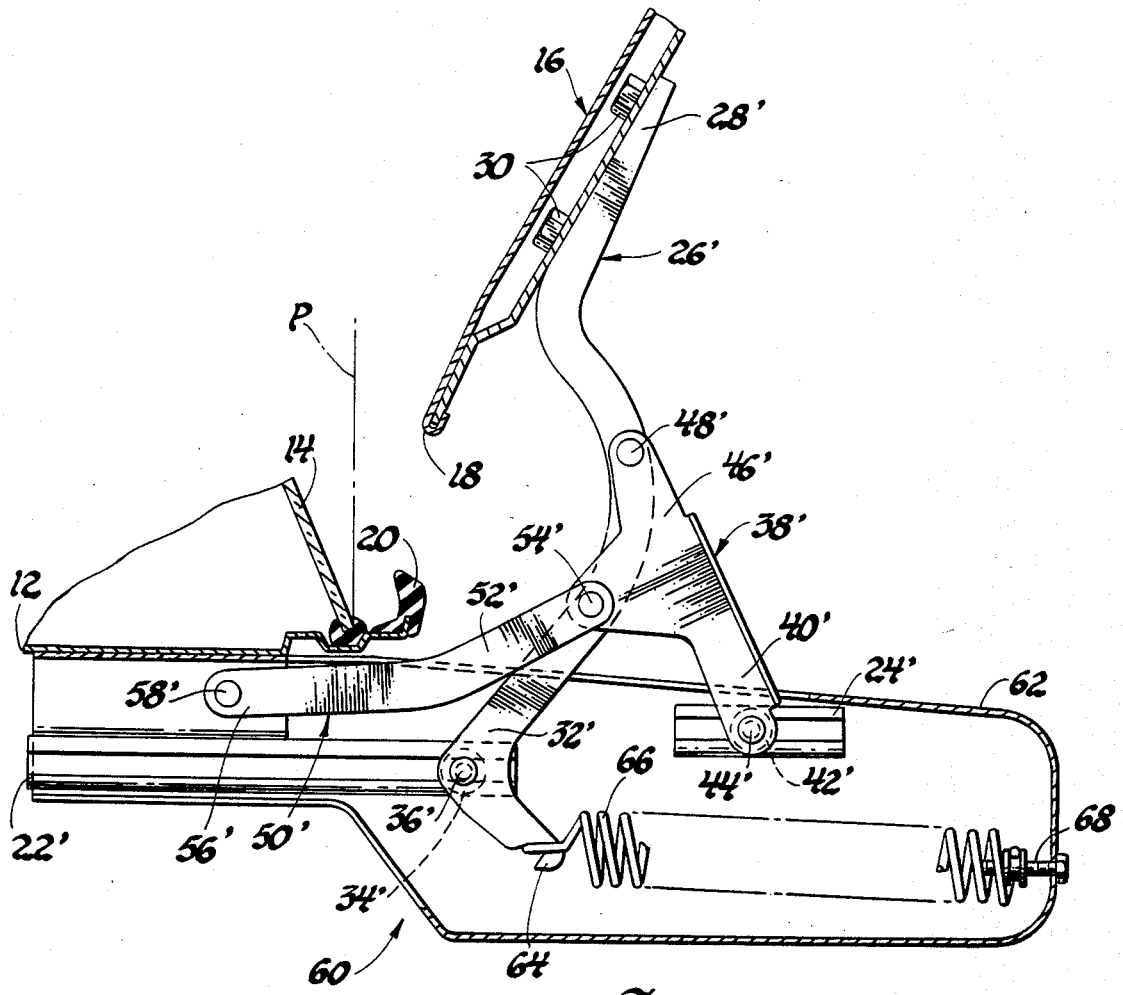
FIG. 5 is a view of the second embodiment with the closure panel in open position.

FIGS. 4–5 show a second embodiment of the invention, designated generally at 60. This will be briefly described, as the opening motion is the same. The second embodiment 60 is designed to be compact and to be assembled as a unit, as well as incorporating a resilient means to assist in opening. The body structure, backlite, deck lid and sealing strip are identical, and are given the same numbers as the first embodiment 10. The closed position of deck lid 16 is shown in FIG. 4, and the open position in FIG. 5. The guide tracks, hinge strap and various links operate in the same fashion, and are given the same numbers with a prime. These elements are not joined directly to the body structure 12, however, but to a hinge box 62, in the same general relative locations as the similar structural elements of embodiment 10. Hinge box 62, with the other structural elements secured thereto, can in turn be joined to the body structure 12 as a unit by any suitable means, and the deck lid 16 then joined to hinge strap 26′. Hinge box 62 serves to enclose and isolate the other structural elements of the assembly, and is shown partially broken away. It will be noted that control link 50′ and follower link 38′ are shorter, and first and second guide tracks 22′ and 24′ are closer together, giving a more compact assembly. This means that control link 50′ will swing in a shorter arc, but will still move upwardly and away relative to the vertical plane P, and the same type of opening motion will result. Another structural difference is a hooked extension 64 on hinge strap 26'. A resilient spring 66 is hooked between extension 64 and a threaded bolt 68 at the rear of hinge box 62. Spring 66 provides a force tending to rotate hinge strap 26' upwardly about headed pin 36'. This force assists in raising deck lid 16 upwardly, and may be balanced with the weight of deck lid 16 to act as a hold open. Other resilient means, such as torque rods, could be joined between the hinge box 62 and the hinge strap 26'. A resilient means could be joined to any other structural element so long as the same rotational bias was given to hinge strap 26' and deck lid 16. The opening motion of deck lid 16 is the same as in embodiment 10, but for the assist given by the spring 66.

It has already been noted that other locations for the control link are possible, as well as different orientations and shapes for the guide tracks. A wide variation of structural element lengths, shapes and sizes is also possible within the basic scope of the invention. Therefore, it will be understood that the invention is capable of being embodied in structures other than those disclosed, and is not intended to be so limited.

The embodiments of the invention in which an exclusive property or privilege is claimed are defined as follows:

1. In an automotive vehicle or the like having body structure and a closure panel movable from a generally horizontal closed position to an open position, said closure panel having an edge, an improved hinge assembly for mounting said closure panel to said body structure so as to shift said closure panel edge away from a generally vertical plane associated with said body structure as said closure panel is raised from said closed position toward said open position, comprising, first and second generally horizontally extending guide means on said body structure, a hinge strap having one end secured to said closure panel and its other end pivotally and slidably connected to said first guide means to provide a first sliding pivot, a follower link having one end thereof pivotally secured relative to said closure panel to provide a first movable pivot and its other end pivotally and slidably connected to said second guide means to provide a second sliding pivot, and a control link having one end pivotally secured to said follower link one end so as to provide a second movable pivot, the other end of said control link being pivotally secured to said body structure so as to provide a fixed pivot at a point such that said control link one end moves upwardly and away relative to said plane when said control link is swung about said fixed pivot, whereby, the initial raising of said closure panel from said closed position swings said control link about said fixed pivot to initially move said control link one end, and thereby move said follower link one end and first and second movable pivots, upwardly and away relative to said plane as said follower link rotates relative to said closure panel about said first movable pivot and said control link rotates relative to said follower link about said second movable pivot, thereby shifting said closure panel edge initially away from said plane, said shifting being accommodated by said first and second sliding pivots, which simultaneously slide horizontally along said respective first and second guide means, continued raising of said closure panel causing said closure panel to tilt upwardly relative to said plane to said open position as said follower link continues to rotate relative to said closure panel about said first movable pivot and said first and second sliding pivots continue to slide horizontally along said respective first and second guide means, thereby precluding the invasion of said plane by said closure panel edge.

2. In an automotive vehicle or the like having body structure and a closure panel movable from a generally horizontal closed position to an open position, said closure panel having an edge, an improved hinge assembly for mounting said closure panel to said body structure so as to shift said closure panel edge away from a generally vertical plane associated with said body structure as said closure panel is raised from said closed position toward said open position, comprising, first and second generally horizontally extending guide means on said body structure, a hinge strap having one end secured to said closure panel and its other end pivotally and slidably connected to said first guide means to provide a first sliding pivot, a follower link having one end thereof pivotally secured relative to said closure panel to provide a first movable pivot and its other end pivotally and slidably connected to said second guide means to provide a second sliding pivot, and a control link having one end pivotally secured to said follower link one end so as to provide a second movable pivot, the other end of said control link being pivotally secured to said body structure so as to provide a fixed pivot at a point such that said control link one end moves in an arc initially upwardly and away from, and then upwardly and toward said plane, when said control link is swung about said fixed pivot, whereby, the initial raising of said closure panel from said closed position swings said control link about said fixed pivot to initially move said control link one end, and thereby move said follower link one end and first and second movable pivots, upwardly and away from said plane as said follower link rotates relative to said closure panel about said first movable pivot and said control link rotates relative to said follower link about said second movable pivot, thereby shifting said closure panel edge initially away from said plane, said shifting being accommodated by said first and second sliding pivots, which simultaneously slide horizontally along said respective first and second guide means in one direction, continued raising of said closure panel causing said closure panel to tilt upwardly relative to said plane as said follower link continues to rotate relative to said closure panel about said first movable pivot and said first and second sliding pivots continue to slide horizontally along said respective first and second guide means guide means in said one direction until said closure panel reaches a partially open position where said control link one end and said second movable pivot begin to move toward said plane, whereupon said second sliding pivot slides horizontally along said second guide means in the opposite direction to accommodate said movement of said control link one end and said second movable pivot toward said plane, whereby said closure panel can tilt upwardly farther relative to said plane as said follower link continues to rotate relative to said closure panel about said first movable pivot, said further upward tilting of said closure panel precluding the invasion of said plane by said closure panel edge.

3. In an automotive vehicle or the like having body structure and a closure panel movable from a generally horizontal closed position to an open position, said closure panel having an edge, an improved hinge assembly securable to said body structure as a unit for mounting said closure panel to said body structure so as to shift said closure panel edge away from a generally vertical plane associated with said body structure as said closure panel is raised from said closed position toward said open position, comprising, a hinge box adapted to be secured to said body structure, first and second generally horizontally extending guide means secured to said hinge box, a hinge strap having one end adapted to be secured to said closure panel after said hinge box has been secured to said body structure and its other end pivotally and slidably connected to said first guide means to provide a first sliding pivot, a follower link having one end thereof pivotally secured to said hinge strap to provide a first movable pivot and its other end pivotally and slidably connected to said second guide means to provide a second sliding pivot, a control link having one end pivotally secured to said follower link one end so as to provide a second movable pivot, the other end of said control link being pivotally secured to said hinge box so as to provide a fixed pivot at a point such that said control link one end moves upwardly and away relative to said plane structure when said control link is swung about said fixed pivot after said hinge box, first and second guide means, hinge strap, follower link and control link have been secured as a unit to said body structure and said closure panel has been secured to said hinge strap one end, and a resilient means joined between one of said hinge strap, control link and follower link and said hinge box so as to provide a force tending to rotate said hinge strap upwardly relative to said plane about said first sliding pivot, whereby, the initial raising of said closure panel from said closed position swings said control link about said fixed pivot to initially move said control link one end, and thereby move said follower link one end and first and second movable pivots, upwardly and away relative to said plane as said follower link rotates relative to said hinge strap and closure panel about said first movable pivot assisted by said resilient means and said control link rotates relative to said follower link about said second movable pivot, thereby shifting said closure panel edge initially away from said plane, said shifting being accommodated by said first and second sliding pivots, which simultaneously slide horizontally along said respective first and second guide means, continued raising of said closure panel causing said closure panel to tilt upwardly relative to said plane to said open position as said follower link continues to rotate relative to said hinge strap and closure panel about said first movable pivot assisted by said resilient means and said first and second sliding pivots continue to slide horizontally along said first and second respective guide means, thereby precluding the invasion of said plane by said closure panel edge.

* * * * *